US005165473A

United States Patent [19]

Bode

[11] Patent Number: 5,165,473

[45] Date of Patent: Nov. 24, 1992

[54] POSITIVE STOP COLLAR

[76] Inventor: Robert E. Bode, 12500 Melville, No. 109A, Montgomery, Tex. 77356

[21] Appl. No.: 716,408

[22] Filed: Jun. 17, 1991

[51] Int. Cl.[5] ..... E21B 33/08

[52] U.S. Cl. ..... 166/192; 166/156; 292/318

[58] Field of Search ..... 166/291, 156, 192, 170; 403/326; 292/318, 320, 324, 328; 285/321, 415

[56] References Cited

U.S. PATENT DOCUMENTS

| | | | |
|---|---|---|---|
| 3,102,595 | 9/1963 | Fisher, Jr. et al. | 166/156 |
| 3,975,040 | 8/1976 | Van Gompel | 292/318 |
| 4,378,838 | 4/1983 | Ogden et al. | 166/156 X |
| 4,408,383 | 10/1983 | Nottingham et al. | 403/328 X |
| 4,588,218 | 5/1986 | Guiler et al. | 292/318 |
| 5,056,837 | 10/1991 | Fuehrer | 292/318 X |

*Primary Examiner*—William P. Neuder
*Attorney, Agent, or Firm*—Dodge, Bush, Moseley & Riddle

[57] ABSTRACT

In accordance with an illustrative embodiment of the present invention, a positively operable stop collar for providing a bridge in a well casing that prevents reverse flow of cement slurry includes a tubular body having upper and lower stop rings positioned in upper and lower recesses therein, seal rings between the recesses, and a bevel on the upper stop ring that is engaged by an inclined surface on the drive plate of a displacement plug to expand the upper stop ring and allow the drive plate to pass through the upper stop ring and to be locked in engagement with the seal rings.

11 Claims, 1 Drawing Sheet

POSITIVE STOP COLLAR

FIELD OF THE INVENTION

This invention relates generally to apparatus for stopping upward flow of cement slurry at a predetermined depth in a well casing, and particularly to a new and improved casing stop collar having unique means for stopping and landing a cement displacement plug in a manner such that the plug prohibits reverse flow of cement after pumping has stopped.

BACKGROUND OF THE INVENTION

When cement slurry is to be pumped down a casing string and into the annulus outside the casing, it is a common practice to incorporate a float collar in the string a selected distance above the bottom. The collar has an upwardly closing ball check valve which allows cement to flow downward, but which prevents upward flow due to "U-tubing". The device is called a float collar because as the casing string is being run into the well bore, the check valve keeps the casing empty of fluids to provide a buoyancy force which reduces the hook load that must be suspended at the rig. The standard float collar has several disadvantages, one being that the check valve provides a considerable restriction to downward flow of cement slurry during a cementing operation. Another disadvantage is that the ball check valve arrangement frequently fails to prevent back-flow of cement because of trash and debris that gets lodged between the ball and its seat.

An object of the present invention is to provide a new and improved stop collar apparatus that cooperates with a cement displacement plug to positively stop cement flow in either direction when the plug reaches a certain distance above the bottom of the casing.

Another object of the present invention is to provide a new and improved stop collar of the type described that is full-bore with respect to cement displacement, and which cooperates with the drive plate of a displacement plug that lands in the collar to seal off the casing bore against flow in either direction.

SUMMARY OF THE INVENTION

These and other objects are attained in accordance with the concepts of the present invention through the provision of a stop collar apparatus including a tubular body adapted to be coupled in a casing string, a lower landing ring thereon, and an expansible and contractible upper landing ring mounted thereon. Seal means is provided between the landing rings and arranged to engage an outer peripheral surface of a drive plate on the lower end of a displacement plug. As the drive plate encounters the upper landing ring during downward movement, it expands this ring and then moves downward in the collar until it encounters the lower landing ring. The lower ring positively stops the drive plate, and the upper ring snaps inward thereabove, so that the plate is trapped between the landing rings. The outer peripheral surface of the drive plate engages the seal means on the stop collar so that reverse flow of cement is prevented. The stop collar provides a substantially full-open flow area in the casing, and there is no opportunity for trash or debris to prevent engagement of the drive plate with the seals.

BRIEF DESCRIPTION OF THE DRAWINGS

The present invention has other objects, features and advantages which will become more clearly apparent in connection with the following detailed description of a preferred embodiment, taking in conjunction with the appended drawings in which.

DETAILED DESCRIPTION OF A PREFERRED EMBODIMENT

Figure 1:
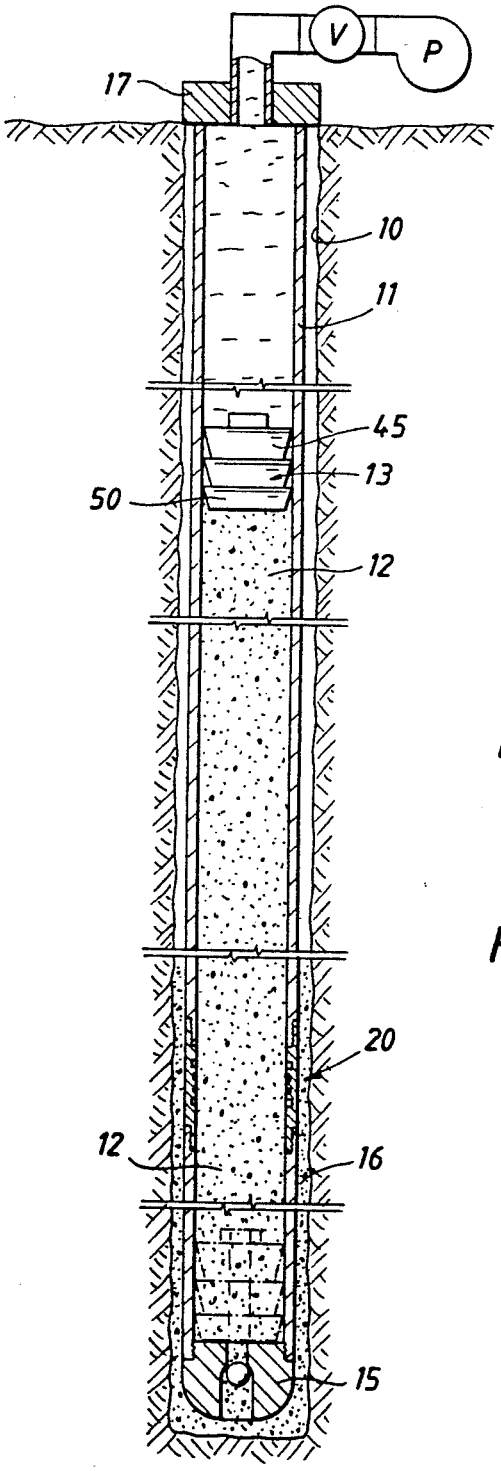
FIG. 1 is a schematic view of a well where a column of cement slurry is being displaced into the casing.

Referring initially to FIG. 1, a well bore 10 having a casing 11 is shown with a column of cement slurry 12 being pumped downward therein ahead of a displacement plug 13. When the lower end of the column 12 reaches a float shoe 15 at the lower end of the casing string 11, further pumping causes the cement to enter the annulus 16 between the casing 11 and the wall of the well bore 10 and flow upward therein toward the surface. The casing 11 typically is suspended at the top of the well 10 at a well head 17. A positive stop collar 20 in accordance with the present invention is located a suitable distance, for example about 80 feet, above the float shoe 15. The collar 20 cooperates with the displacement plug 13 that separates the upper end of the cement column 12 from the displacement fluids thereabove in order to close off the casing bore when the plug reaches the collar, and thereby prevent cement from U-tubing back up the bore of the casing 11 as the cement hardens to bond the casing to the borehole wall. 9 wiper plug 13' shown in phantom lines in FIG. 1 can be used ahead of the cement column 12. This plug passes through the stop collar 20 and lands on the shoe 15, where a differential pressure can be used to open a central flow path therethrough.

Figure 2:
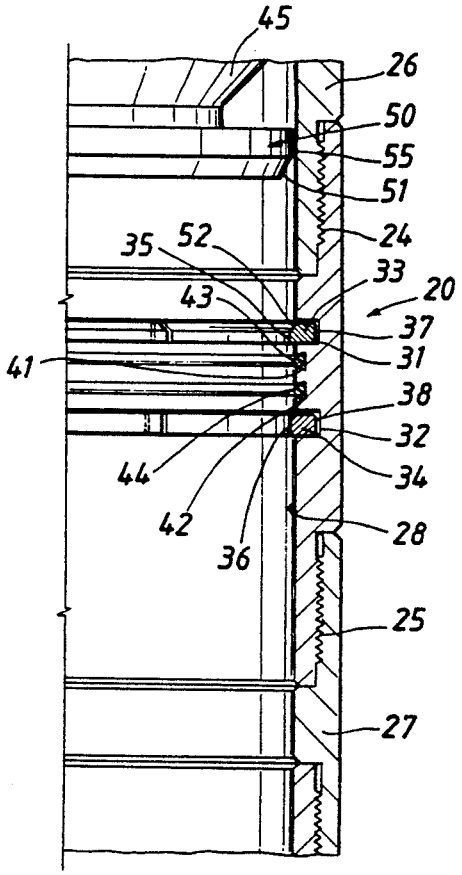
FIG. 2 is an enlarged, right-side only, cross-sectioned view of the stop collar and the drive plate of the plug assembly.
Figure 3:
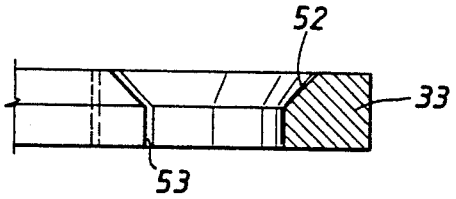
FIGS. 3 and 4 are further enlarged, fragmentary views of the landing rings.
Figure 4:
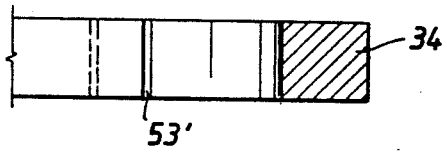

As shown in detail in FIG. 2, the stop collar 20 has threads 24 and 25 as its respective upper and lower ends to connect to upper casing 25 and a lower casing collar 27. The internal bore 28 of the collar 20 has the same internal dimension as the casing sections 26 and 27, and therefore is full-opening or full-bore. The collar 20 is provided with axially spaced upper and lower internal annular recesses 31, 32 which receive landing rings 33, 34. The rings 33, 34 are each split as shown in FIGS. 3 and 4 so as to be radially expansible and contractible, and the rings are sized such that their inner surfaces 35, 36 are located somewhat inwardly of the wall of the bore 28. Also, their outer wall surfaces 37, 38 normally are spaced inwardly of the respective outer walls of the grooves or recesses 31, 32 so that at least the upper ring 33 can be expanded somewhat from its relaxed condition. A pair of annular grooves 41, 42 are formed in the wall of the collar 20 between the recesses 31, 32 and receive O-ring seals 43, 44. The O-ring seals 43, 44 preferably are sized such that their innermost surface extends slightly into the bore 28 of the collar 20. To prevent roll-out of the seal rings 43, 44, each groove 31, 32 preferably has oppositely inclined side walls as shown.

The displacement plug 13 has a series of upwardly facing seal cups 45 whose outer lips engage the internal wall of the casing 11, the cups being mounted on a central mandrel that has a drive plate 50 at its lower end. The lower outer edge 51 of the drive plate 50 is beveled so as to incline downward and inward. As shown more clearly in FIG. 3, the upper locking ring 33 has a beveled surface 52 at its upper end that inclines upward and outward. The ring 33 is split at 53 on about a 45° angle with respect to radial, which allows it to be compressed in order to position it in the groove 31. The lower ring 34 is constructed much like the upper ring 33, except that it has no bevel as shown in FIG. 4. Thus the lower ring 34 also can be compressed in order to insert it in the lower groove 42, however it will positively stop the drive plate 50 against downward movement. After the upper edge of the drive plate 50 has passed through the top ring 33, the ring will resile inward and lock the drive plate against upward movement. The outer peripheral surface 55 of the drive plate 50 is sized with respect to the i.d. of the O-rings 43, 44 such that when the drive plate is locked between the landing rings 31 and 32, the O-rings are placed under an appropriate amount of squeeze, for example 8–10%.

OPERATION

In use, the stop collar 20 is coupled in the casing string 10 as it is being run, so that the collar is positioned a selected distance above the bottom of the string (i.e. 1–2 joints thereabove). Cement slurry is pumped into the casing 10, with or without the wiper plug 13' ahead of it, until a predetermined number of barrels of cement has been pumped. Then the displacement plug 13 is injected into the bore of the casing 10 to define the upper end of the cement column 12. The column 12 is then displaced under pressure down the casing 10. The wiper plug 13' readily passes through the stop collar 20 and lands on top of the float shoe 15. A rupture element (not shown) in the wiper plug 13' opens under pressure so that the cement flows down through the float shoe 15 and out into the annulus 16 until the upper displacement plug 13 reaches the stop collar 20.

Figure 5:
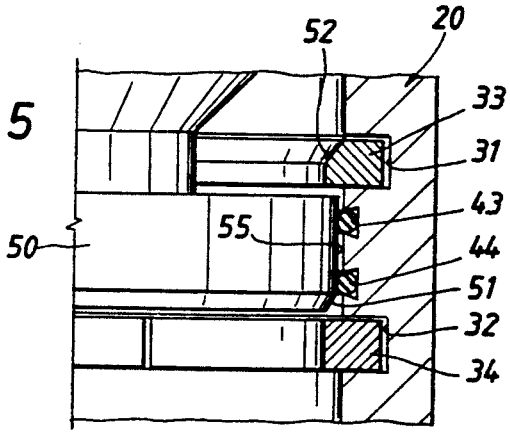
FIG. 5 is a fragmentary view showing the drive plate trapped between the landing rings.

The inclined surface 51 of the drive plate 50 cams and thereby expands the upper landing ring 33 outward into its recess 31 to allow the plate to pass through it. However, when the plate 50 encounters the lower landing ring 34, it is positively stopped thereby. The upper ring 33 resiles inward above the plate 50 as shown in FIG. 5 to trap it between the rings. The O-rings 43 and 44 sealingly engage the outer surface 55 of the plate 50 to prevent leakage. Thus the cement slurry cannot "U-tube" upward within the casing 11 past the plate 50. After a sufficient lapse of time the cement will harden in the annulus 16 to bond the casing 11 to the bore hole wall 10.

The positively locked and sealed condition of the drive plate 50 within the stop collar 20 allows the casing 11 to be tested by applying internal pressure thereto at the surface to the maximum internal yield pressure. Preferably, the landing rings 33 and 34 are made of a high textile strength plastic material, although various metals could be used.

It now will be recognized that a new and improved positive stop collar assembly for use in well cementing operations has been disclosed. Until the displacement plug 13 reaches the stop collar 20, the casing is substantially full-bore so that cement slurry can be readily displaced downward therein. There is no opportunity for trash or debris to prevent operation of the present invention. The plate 50 of the plug 13 is positively stopped, locked and sealed in the collar 20 so that reverse flow of cement slurry cannot occur. Since certain changes or modifications may be made in the disclosed embodiment without departing from the inventive concepts involved, it is the aim of the appended claims to cover all such changes and modifications falling within the true spirit and scope of the present invention.

What is claimed is:

1. Apparatus for use in closing the bore of a well casing against downward or upward fluid flow, comprising; a tubular body having means at its ends for coupling said body in a well conduit, upper and lower ring means on said body, said upper ring means being expansible and retractable to allow downward passage of a plate member therethrough and to prevent upward movement thereof, said lower ring means providing a stop against downward movement of a plate member; and means on said tubular body between said ring means and engageable with a plate member for preventing leakage.

2. The apparatus of claim 1 further including upper and lower internal annular recess means for receiving said respective ring means, each of said ring means having a split formed there through to allow compression and reduction of the diameter during insertion into said recess means.

3. The apparatus of claim 2 where said upper ring means has an upward and outwardly inclined surface at its upper end which allows a companion inclined surface of a plate member to expand said upper ring means during downward passage of the plate member therethrough.

4. The apparatus of claim 2 where said lower ring means has a transverse upper surface that provides a stop against downward movement of a plate member.

5. Apparatus for use in positively preventing reverse flow of cement slurry in a well conduit during cementing thereof in a well bore, comprising: a tubular body having a bore and means at its ends adapted to connect said body in a well conduit; upper and lower, longitudinally spaced, internal annular recess means in said bore of said body; upper and lower stop rings positioned respectively in said upper and lower recess means, each of said rings having a relaxed internal diameter that is less than the internal diameter of said bore; and seal means in said bore between said stop rings, each of said rings being circumferentially discontinuous to allow contraction and expansion thereof, said upper ring having an upward and outwardly inclined surface which allows it to be expanded by a member passing downward in the well conduit into engagement with said seal means and said lower stop ring, said upper ring resiling inward to trap said member against said lower ring.

6. The apparatus of claim 5 wherein said upper recess means has an outer diameter that is greater than the relaxed diameter of said upper ring to allow radial expansion thereof as said member passes downward therethrough.

7. The apparatus of claim 5 wherein each of said rings has a slot cut therethrough to provide said circumferential discontinuity.

8. The apparatus of claim 7 wherein each of said slots is formed at an angle with respect to a radius of a respective ring to allow each of said rings to be compressed and inserted into its respective recess means during assembly.

9. The apparatus of claim 8 wherein said angle is about 45°.

10. The apparatus of claim 5 further including a displacement plug having a plate member on the lower end thereof; said plate member having a downward and inwardly inclined surface on the lower outer edge thereof that is cooperable with said inclined surface means on said upper ring to expand it into said upper recess means and thereby allow said plate member to move downward into engagement with said seal means and said lower ring, said upper ring then resiling inward over a upper outer edge of said plate member to trap said plate member against longitudinal movement in either direction in said conduit.

11. The apparatus of claim 5 where said tubular body is connected in the well conduit a predetermined distance above the bottom end of the conduit.

* * * * *